US010619443B2

(12) United States Patent
Peer et al.

(10) Patent No.: US 10,619,443 B2
(45) Date of Patent: Apr. 14, 2020

(54) TOPSIDE STANDALONE LUBRICATOR FOR BELOW-TENSION-RING ROTATING CONTROL DEVICE

(71) Applicant: Halliburton Energy Services, Inc., Houston, TX (US)

(72) Inventors: Richard David Peer, Katy, TX (US); James Randolph Lovorn, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 74 days.

(21) Appl. No.: 15/529,059

(22) PCT Filed: Jul. 14, 2016

(86) PCT No.: PCT/US2016/042213
§ 371 (c)(1),
(2) Date: May 23, 2017

(87) PCT Pub. No.: WO2018/013115
PCT Pub. Date: Jan. 18, 2018

(65) Prior Publication Data

US 2018/0328134 A1 Nov. 15, 2018

(51) Int. Cl.
*E21B 33/072* (2006.01)
*E21B 19/00* (2006.01)
(Continued)

(52) U.S. Cl.
CPC ..... *E21B 33/072* (2013.01); *E21B 17/01* (2013.01); *E21B 19/00* (2013.01); *E21B 19/004* (2013.01);
(Continued)

(58) Field of Classification Search
CPC .... E21B 33/072; E21B 33/035; E21B 33/085; E21B 17/01; E21B 17/07; E21B 19/00; E21B 19/006
See application file for complete search history.

(56) References Cited

U.S. PATENT DOCUMENTS 4,059,148 A * 11/1977 Blomsma ..... E21B 7/128 166/208
4,083,504 A * 4/1978 Wattles ..... B02C 13/14 241/275
(Continued)

OTHER PUBLICATIONS

International Search Report and Written Opinion dated Apr. 12, 2017; International PCT Application No. PCT/US2016/042213.

*Primary Examiner* — Matthew R Buck
*Assistant Examiner* — Aaron L Lembo
(74) *Attorney, Agent, or Firm* — McGuireWoods, LLP.

(57) ABSTRACT

Well systems and methods are provided. An example well system comprises a lubricator assembly. The lubricator assembly comprises a lubricator head. The lubricator head comprises a removable sealing cartridge, a plurality of sealing elements disposed in the sealing cartridge, and a lubricating fluid cavity disposed between two individual sealing elements of the plurality of sealing elements. The lubricator assembly further comprises a lubricator body. The lubricator body comprises a lubricator seal conduit pipe. The example well system also comprises a slip joint coupled to the lubricator seal conduit pipe and a statically underbalanced drilling fluid disposed in the lubricator seal conduit pipe.

15 Claims, 4 Drawing Sheets

(51) Int. Cl.

| | |
|---|---|
| ***E21B 33/076*** | (2006.01) |
| ***E21B 17/01*** | (2006.01) |
| ***E21B 33/035*** | (2006.01) |
| ***E21B 33/08*** | (2006.01) |
| *E21B 17/07* | (2006.01) |

(52) U.S. Cl.
CPC ..... *E21B 33/035* (2013.01); *E21B 33/076* (2013.01); *E21B 33/085* (2013.01); *E21B 17/07* (2013.01); *E21B 19/006* (2013.01)

(56) References Cited

U.S. PATENT DOCUMENTS 4,154,448 A * 5/1979 Biffle ..... E21B 33/085 166/84.1
4,836,289 A * 6/1989 Young ..... E21B 33/072 166/379
4,940,095 A * 7/1990 Newman ..... E21B 19/22 166/378
5,348,107 A * 9/1994 Bailey ..... E21B 33/085 175/162
5,379,845 A * 1/1995 Blount ..... E21B 7/061 166/117.6
6,609,571 B2 8/2003 Nice et al.
8,047,285 B1 * 11/2011 Smith ..... E21B 4/02 166/260
8,127,854 B2 3/2012 Haheim
8,286,712 B2 * 10/2012 Wilson ..... E21B 19/002 166/338
8,689,879 B2 * 4/2014 Patel ..... E21B 21/00 166/311
8,701,796 B2 4/2014 Bailey et al.
8,857,520 B2 * 10/2014 Hoffman ..... E21B 33/038 166/338
9,328,575 B2 * 5/2016 Feasey ..... E21B 21/08
9,605,495 B2 * 3/2017 Reinas ..... E21B 17/07
9,745,830 B2 * 8/2017 Lake ..... E21B 34/08
2002/0185276 A1 * 12/2002 Muller ..... E21B 33/068 166/297
2003/0010498 A1 * 1/2003 Tolman ..... E21B 33/068 166/305.1
2003/0106712 A1 * 6/2003 Bourgoyne ..... E21B 21/001 175/5
2006/0124314 A1 6/2006 Haheim et al.
2011/0005767 A1 * 1/2011 Muff ..... E21B 33/076 166/345
2011/0174503 A1 * 7/2011 Elsayed ..... E21B 17/025 166/385
2015/0075804 A1 3/2015 Orbell et al.
2015/0369000 A1 * 12/2015 Leuchtenberg ..... E21B 33/06 166/387
2017/0159393 A1 * 6/2017 Orban ..... E21B 33/062
2018/0038177 A1 * 2/2018 Leuchtenberg ..... E21B 21/001
2018/0045013 A1 * 2/2018 Stephen ..... E21B 21/106
2018/0163493 A1 * 6/2018 Le ..... E21B 33/03
2018/0163494 A1 * 6/2018 Le ..... E21B 33/03

* cited by examiner

TOPSIDE STANDALONE LUBRICATOR FOR BELOW-TENSION-RING ROTATING CONTROL DEVICE

TECHNICAL FIELD

The present disclosure relates generally to equipment utilized and operations performed in conjunction with managed pressure drilling operations and, more particularly, to inserting wireline and/or tubing while maintaining the managed pressure drilling mode.

BACKGROUND

Managed pressure drilling (MPD) is a drilling method used to control the annular pressure throughout a wellbore. Specifically, the annular pressure is kept slightly above the pore pressure to prevent the influx of formation fluids into the wellbore, but it is maintained well below the fracture initiation pressure. This is generally performed by using a drilling fluid that is weighted to be statically underbalanced relative to pore pressure, and by using surface back pressure generated by choke restrictions, to maintain a dynamic overbalanced state. The annular pressure is controlled by the use of a rotating control device (RCD). The RCD comprises a sealing element which forms a seal that creates a closed loop in the drilling system. The RCD diverts flow to the chokes, which as just discussed, are the pressure regulators for the closed loop. The dynamic control of annular pressures enables drilling wells that might not otherwise be practical.

In MPD operations when inserting wireline or tubing, processes which may be referred to as wirelining or tripping respectively, the closed loop provided by the RCD may need to be broken. This process is referred to as taking the well out of MPD mode. In order to maintain a proper pressure in the wellbore, this also requires a complete circulation and replacement of the statically underbalanced drilling fluid for a drilling fluid weighted to be overbalanced relative to pore pressure. This process requires additional time and expense. Further, the transition out of MPD mode may expose the formation to pressure changes which may induce formation damage. These problems are repeated when the wirelining or tripping operations are completed and the well has to be transitioned back into MPD mode. Moreover, the wirelining or tripping operations must be performed slowly as the sealing element of the RCD is not lubricated and may be damaged by wireline or tubing if the wirelining or tripping operation is not done at a sufficiently slow speed.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates generally to equipment utilized and operations performed in conjunction with MPD operations and, more particularly, to inserting wireline and/or tubing while maintaining the MPD mode.

Disclosed herein are examples and methods for using a topside lubricator to form a seal around wireline or tubing as it is inserted into a wellbore while maintaining the well in MPD mode to continue the control of the pressure at the bottom of the wellbore. The lubricator generally comprises a lubricator head positioned topside (i.e. above the upper slip joint) and which is chambered. The lubricator head forms a seal, and the wireline or tubing is inserted through the lubricator head. The lubricator also comprises a lubricator body which is coupled below the lubricator head and comprises a conduit which may attach to and terminate at the upper slip joint or may attach to an RCD body adapter (via coupling to additional conduit pipe) and terminate within the RCD if desired. The RCD sealing element and bearings are removed; however, the seal formed by the lubricator may function to keep the closed loop used to perform MPD functional and as such, the statically underbalanced drilling fluid does not need to be circulated and replaced and the well need not be transitioned out of MPD mode. Examples of the present disclosure and its advantages may be understood by referring to FIGS. 1 through 4, where like numbers are used to indicate like and corresponding parts.

Figure 1:
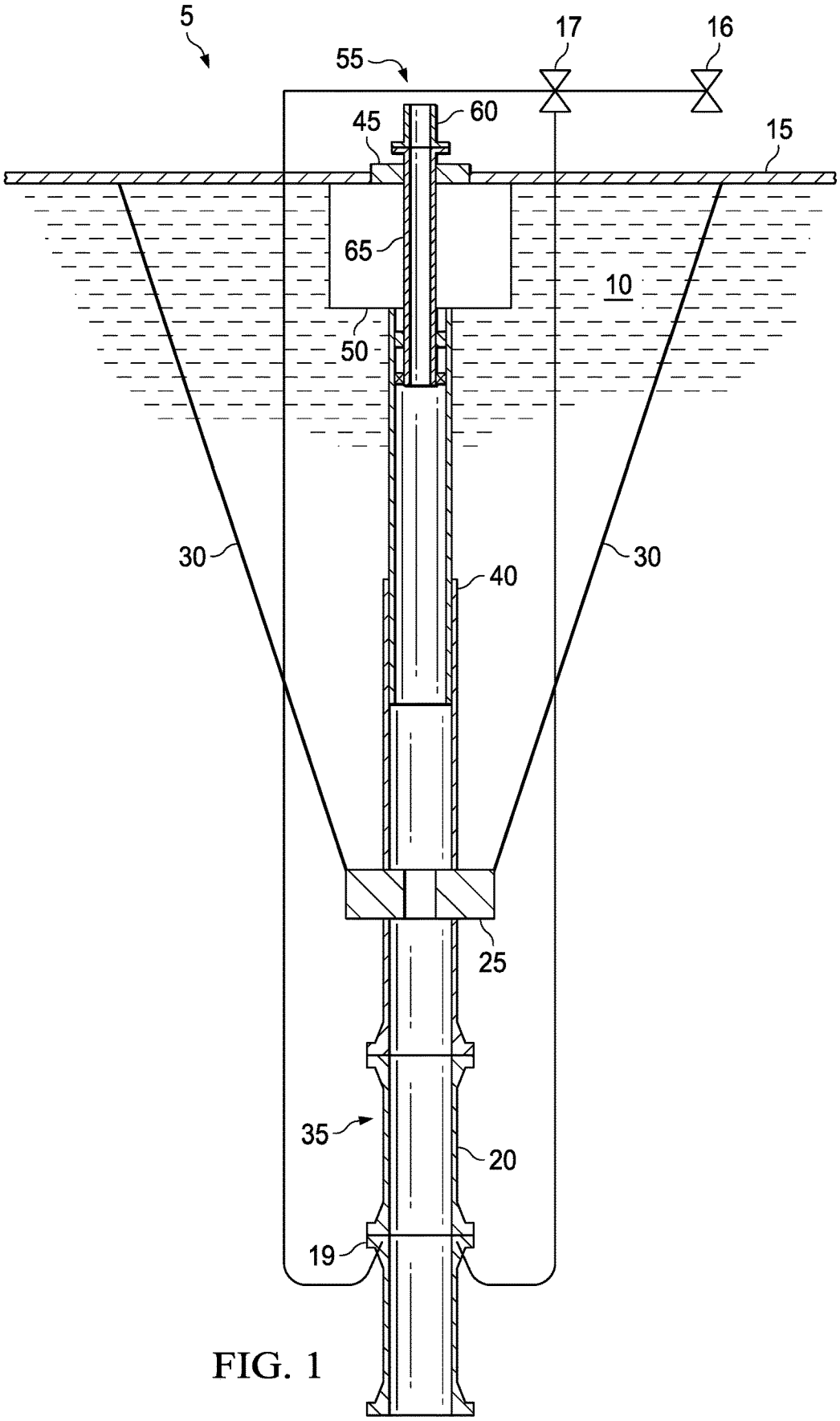
FIG. 1 is an elevation view of a well-production system.

FIG. 1 is an elevation view of a well drilling system 5 in the transition state used for wirelining or tripping operations. Well drilling system 5 may be used in offshore drilling operations conducted in body of water 10. Well drilling system 15 may be used for MPD operations in a subsea wellbore (not pictured for ease of illustration) penetrating the sea floor (not pictured for ease of illustration). Well drilling system 5 descends from the surface of rig floor 15 and into body of water 10. An RCD 20 allows for pressure containment by creating a closed loop through which the drilling fluid circulates and through which annular pressure may be regulated as desired. Although not shown, it is to be understood that the drill string is still capable of advancing into the wellbore and rotating within this closed loop system when the well drilling system 5 is used for drilling. Generally, surface backpressure is applied by restricting flow through the use of controllably adjustable chokes 16 and the buffer manifold 17. The pressure is applied via the MPD flow lines 18 to the flow spool 19 which may be proximate the RCD 20 the. For example, a pressure differential across the choke 16 may be adjusted to cause a corresponding change in annular pressure. In some MPD operations, a drilling fluid that is weighted to be statically underbalanced relative to pore pressure may be used. Surface backpressure may be generated by the chokes 16 to maintain a dynamic overbalanced state. Thus, a desired downhole pressure at a predetermined location (e.g., pressure at the bottom of the wellbore, pressure at a downhole casing shoe, pressure at a particular formation or zone, etc.) may be conveniently regulated by varying the backpressure applied at the surface in the closed loop created by the RCD 20. Well drilling system 5 is illustrated in the transition state used for wirelining or tripping operations. As such, the drill string is not present and a lubricator assembly 55 has been installed above the slip joint 40 or uppermost riser of the riser string 35.

In well drilling system 5, RCD 20 may be used to create a seal around the drill pipe during the drilling portion of an MPD operation. RCD 20 generally comprises a sealing element and bearings which are used to form the seal around the drill string. When the wellbore is being drilled, the sealing element would seal around the drill string which would descend from the rotary table 45 passing through the slip joint 40 and the riser string 35. In a general MPD operation, the seal formed by the RCD 20 sealing element creates a closed loop that allows for pressure regulation of the annular pressure and the pressure at the bottom of the wellbore. In the illustrated example, the drill string has been pulled from the well drilling system 5 in order to perform a wirelining or tripping operation. As discussed above, when wirelining or tripping operations are performed, the seal which forms the closed loop system provided by the sealing element of the RCD 20 may need to be broken to allow the wireline or tubing to be inserted through the RCD 20. The sealing element of the RCD 20 may not be able to form a seal around the wireline or tubing during these operations, and the closed loop system is not able to be maintained. At this transitional period the well is referred to as being taken out of MPD mode, as the pressure is no longer dynamically managed via the closed loop system described above. As such, without a closed loop system to dynamically manage the annular pressure and the pressure at the bottom of the wellbore, the statically underbalanced drilling fluid used in MPD operations must be completely circulated and replaced with an overbalanced drilling fluid relative to pore pressure. The overbalanced drilling fluid restricts flow of formation fluids into the wellbore during this transition period. In this open state the annulus is not closed off via the RCD 20 and the wellbore pressure is generally controlled by adjusting the density of the overbalanced drilling fluid. FIG. 1 illustrates an example well drilling system 5 in said transition period and which maintains a closed loop system using lubricator assembly 55 and which does not use the sealing element of RCD 20. The lubricator assembly 55 may restrict the ingress of a wellbore fluid (e.g., a drilling fluid) disposed in a conduit (e.g., a conduit of the lubricator assembly, a slip joint, a conduit of a riser string, etc.) from flowing through the entirety of the lubricator assembly 55. As such, lubricator assembly 55 is able to maintain a closed loop wherein a wellbore fluid does not flow through lubricator assembly 55 while a wireline, tubing, or other conduit is passed through lubricator assembly 55.

With continued reference to FIG. 1, the example well drilling system 5 illustrates that the RCD 20 is positioned below a tension ring 25. Tension ring 25 may be suspended in place by tensioners 30. Tensioners 30 provide sufficient tension force to maintain the stability of the tension ring and any riser strings 35 or related components attached to the tension ring 25 in an offshore environment. Tensioners 30 are used to suspend tension ring 25 from the rig floor 15 as illustrated. Tension ring 25 and tensioners 30 may be any tension ring 25 and tensioners 30 sufficient for use with the disclosed well drilling system 5. It is to be understood that the apparatuses and methods described herein are not to be limited to any specific class or model of tension ring 25 or tensioner 30. Further, well drilling system 5 may utilize any equivalent tensioning configuration to maintain the tension of riser string 35.

As illustrated in FIG. 1, tension ring 25 may be used to support riser string 35 in body of water 10 and to maintain sufficient tension within riser string 35 such that riser string 35 is minimally affected by motion within body of water 10 (e.g., waves and currents) and does not collapse or otherwise lose stability. Riser string 35 comprises risers and any related component, for example RCD 20, which is installed in riser string 35. The risers within riser string 35 may generally be described as conduits that provide an extension of a subsea wellbore to a surface drilling facility. As such, in a drilling operation, for example MPD, the drill pipe would be positioned within riser string 35, and the wellbore annulus would extend into the riser string 35 up to the RCD 20 which would form a seal around the drill pipe to seal off the extended wellbore annulus. Riser string 35 may be coupled to a blowout preventer positioned on the seafloor (not illustrated). Riser string 35 may also comprise high pressure choke lines (not illustrated) used to circulate fluids to the blowout preventer from chokes 16. Riser string 35 and RCD 20 may be any riser string 35 and RCD 20 sufficient for use with the disclosed well drilling system 5. It is to be understood that the apparatuses and methods described herein are not to be limited to any specific class or model of riser string 35 and RCD 20.

As illustrated in FIG. 1, well drilling system 5 comprises a slip joint 40 positioned above tension ring 25 and below the rig floor 15. Slip joint 40 is a telescoping jointed conduit which permits vertical motion while maintaining the stability of the riser string 35 as it is coupled to the blowout preventer on the seafloor. The slip joint 40 is configured to telescope in or out by the same amount so that the riser string 35 below the slip joint 40 is relatively unaffected by vertical motion of the rig and consequently the rig floor 15. Slip joint 40 may be any slip joint 40 sufficient for use with the disclosed well drilling system 5. It is to be understood that the apparatuses and methods described herein are not to be limited to any specific class or model of slip joint 40. Further, well drilling system 5 may utilize any equivalent configuration to permit vertical motion of the floating vessel from which the riser string 35 descends. In some examples, well drilling system 5 may not comprise a slip joint 40 and may be configured such that riser string 35 extends up to lubricator assembly 55.

As illustrated in FIG. 1, well drilling system 5 comprises a diverter box 50 positioned above slip joint 40. Diverter box 50 may divert flow away from the risers, for example, to the shakers or through the diverter lines. Diverter box 50 may be any diverter box 50 sufficient for use with the disclosed well drilling system 5. It is to be understood that the apparatuses and methods described herein are not to be limited to any specific class or model of diverter box 50. Further, well drilling system 5 may utilize any equivalent configuration to divert the flow of drilling fluid as desired.

In the example methods described herein, and with continued reference to FIG. 1, when wirelining or tripping operations are desired, the drill string within the riser string 35 and the slip joint 40 is removed. Further, the sealing element and bearing assembly within RCD 20 are also removed. As illustrated in FIG. 1, the drill pipe, RCD 20 sealing element, and RCD 20 bearing assembly are not present. These components may be removed in any desirable manner. After these components have been removed, a lubricator assembly 55 may be installed. The lubricator assembly 55 comprises a lubricator head 60 and lubricator body 65. The lubricator head 60 is installed above the rotary table 45 on the rig floor 15. The lubricator body 65 is installed below the lubricator head 60 and may traverse the rotary table 45. The lubricator body 65 may also traverse or be positioned adjacent to the diverter box 50 in some examples.

Figure 2:
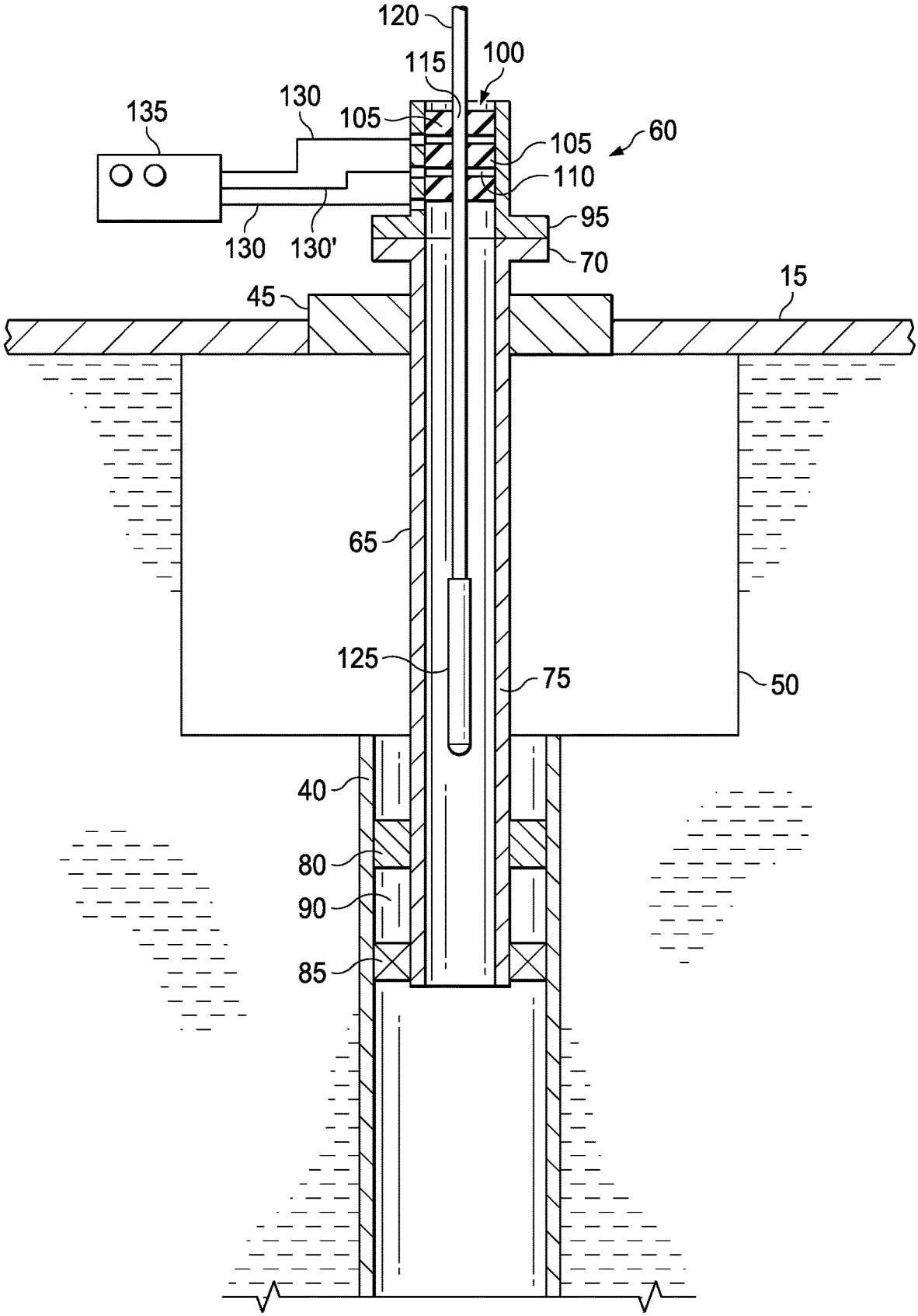
FIG. 2 is a cross-sectional view of a lubricator assembly within the well-production system of FIG. 1.

With reference to FIG. 2, lubricator body 65 generally comprises a lubricator body flange 70 and lubricator seal conduit pipe 75. The lubricator body 65 may be installed by lowering lubricator seal conduit pipe 75 through the rotary table 45. The lubricator body flange 70 of the lubricator body 65 may be positioned by slips or bushings within the rotary table 45 to prevent downward movement. In some examples, the lubricator body flange 70 may rest on the rotary table bushings. In the example illustrated by FIG. 2, the lubricator seal conduit pipe 75 terminates in an upper portion of slip joint 40. In examples in which slip joint 40 is not present, the lubricator seal conduit pipe 75 may terminate in a portion of the uppermost riser of riser string 35. Latch assembly 80 forms a latch between lubricator seal conduit pipe 75 and a portion of slip joint 40 such that lubricator seal conduit pipe 75 is coupled to slip joint 40. Latch assembly 80 may be any sufficient latch assembly for coupling lubricator seal conduit pipe 75 to slip joint 40. Latch assembly 80 may be a mechanical, hydraulic, or electric latch assembly. For example, latch assembly 80 may be hydraulically actuated from the rig floor 15 by introducing a hydraulic pressure via tubing to the hydraulic latch setting mechanism to form a hydraulic latch between lubricator seal conduit pipe 75 and slip joint 40. Alternatively, latch assembly 80 may be set using mechanical actuation via axial motion of the lubricator seal conduit pipe 75 within the slip joint 40 to form a mechanical latch. It is to be understood that latch assembly 80 may be any latch assembly 80 sufficient for use with the disclosed well drilling system 5. It is to be understood that the apparatuses and methods described herein are not to be limited to any specific class or model of latch assembly 80. Further, well drilling system 5 may utilize any equivalent configuration to secure lubricator seal conduit pipe 75 within slip joint 40.

With continued reference to FIG. 2, packer assembly 85 seals off the annulus 90 between lubricator seal conduit pipe 75 and slip joint 40. Packer assembly 85 comprises one or more packers sufficient for restricting fluid flow into annulus 90. The packers used for packer assembly 85 may be made of any material sufficient for restricting fluid flow into annulus 90. Examples of materials may include, but are not limited to, elastomeric materials, thermoplastic materials, thermosetting materials, composites thereof, or combinations thereof. It is to be understood that packer assembly 85 may be any packer assembly 85 sufficient for use with the disclosed well drilling system 5. It is to be understood that the apparatuses and methods described herein are not to be limited to any specific class or model of packer assembly 85. Further, well drilling system 5 may utilize any equivalent configuration to isolate the annulus 90 between the slip joint 40 and the lubricator seal conduit pipe 75.

With continued reference to FIG. 2, once the latch assembly 80 and packer assembly 85 have been set, the lubricator head 60 may be mounted on to the lubricator body 65. The lubricator head 60 may comprise a lubricator head flange 95 which may be coupled to and sealed with lubricator body flange 70. In alternative examples, additional coupling methods may be used such as threading the lubricator head 60 into lubricator body 65. In some examples, the lubricator head 60 may be one continuous piece with lubricator body 65.

Lubricator head 60 comprises sealing cartridge 100. Sealing cartridge 100 may be removable from lubricator head 60. Sealing cartridge 100 may be a container comprising a plurality of sealing elements 105 and lubricator cavities 110. Sealing elements 105 may comprise, but are not limited to, elastomeric materials, thermoplastic materials, thermosetting materials, composites thereof, or combinations thereof. The sealing elements 105 comprise an inner diameter 115. A wireline 120 with a logging tool 125 may traverse the inner diameter 115 of the sealing elements 105. In alternative examples, tubing (e.g., coiled tubing) may traverse the inner diameter 115 of the sealing elements 105. The sealing elements 105 form a seal around the wireline 120 (or tubing if provided). The sealing elements 105 are selected such that the length of the diameter of the inner diameter 115 is able to sufficiently seal around the wireline 120. In some example methods, a sealing cartridge 100 comprising a plurality of sealing elements 105 of one size may be removed if desired and exchanged for a different sealing cartridge 100 comprising a plurality of sealing elements 105 of a different size if desired. For example, if a wirelining operation requires sealing elements 105 of a first size, upon completion of said wirelining operation, the sealing cartridge 100 comprising the sealing elements 105 of a first size may be removed from lubricator head 60 and replaced with a second sealing cartridge 100 comprising sealing elements 105 of a second size to perform a subsequent operation, for example a tripping operation.

As illustrated in FIG. 2, sealing cartridge 100 may comprise a plurality of sealing elements 105 as desired. For example, sealing cartridge 100 may comprise two or more sealing elements 105. As another example, sealing cartridge 100 may comprise two, three, four, five, six, seven, eight, or more sealing elements 105. Sealing elements 105 may be generally ring-shaped with the outer diameter mounted in the sealing cartridge 100 and the inner diameter 115 sized such that it is able to seal around the outer diameter of a desired object passing there through, for example, wireline 120, coiled tubing, etc.

With continued reference to FIG. 2, lubricator cavities 110 may be positioned adjacent to two sealing elements 105 in sealing cartridge 100 such that lubricator cavities 110 may be positioned between two sealing elements 105. Lubricator cavities 110 contain a lubricating substance. The lubricating substance may be any type of lubricating substance sufficient for lubricating sealing elements 105 and any material passing through sealing elements 105, for example, wireline 120. The lubricating substance may generally comprise an oil and/or other fluid lubricant that is mixed with a thickener, typically a soap, to form a solid or semisolid. A specific example of a lubricating substance is grease. Another specific example of a lubricating substance is petroleum jelly. Another specific example of a lubricating substance is wax. The lubricating substance may also be sufficiently viscous to assist sealing elements 105 in sealing around any material passing through sealing elements 105, for example, wireline 120, by resisting the ingress of wellbore fluids (e.g., the drilling fluid). Lubricator cavities 110 connect to lubricator hoses 130. Lubricator hoses 130 supply lubricator cavities with a sufficient amount of lubricating substance to lubricate the sealing elements 105. Sealing cartridge 100 may comprise a plurality of lubricator cavities 110 as desired. For example, sealing cartridge 100 may comprise two or more lubricator cavities 100. As another example, sealing cartridge 100 may comprise two, three, four, five, six, seven, eight, or more lubricator cavities 110. One or more lubricator hoses 130 may be connected to an individual lubricator cavity 110.

In the illustration of FIG. 2, the bottommost lubricator hose 130' provides the lubricating substance below the bottom sealing element 105 in the sealing cartridge 100. This bottommost lubricator hose 130' may supply the lubricating substance directly on to the pressurized drilling fluid residing within the lubricator seal conduit pipe 75. This bottommost lubricator hose 130' may supply the lubricating substance at a pressure above the wellbore pressure as desired to prevent the ingress of wellbore fluid. Alternatively, the bottommost lubricator hose 130' may be the lubricator hose 130 which connects to the bottom lubricator cavity 110. In this alternative example, the bottom lubricator cavity 110 would contain the lubricating substance at above wellbore pressure. "Bottommost" and "bottom" as used herein to refer to the lubricator hoses 130, lubricator cavities 110, and sealing elements 105, refers to the individual component in a plurality of the same components which would be the first to contact a wellbore fluid rising out of the well. The remaining lubricator cavities 110 and lubricator hoses 130 may comprise a volume of the lubricating substance at equally staged pressures below that of the pressure used for the bottommost lubricator hose 130 and/or lubricator cavity 110.

Lubricator injection unit 135 is coupled to lubricator hoses 130. Lubricator injection unit 135 may pressurize the lubricating substance for injection via lubricator hoses 135. Lubricator injection unit 135 may comprise one or more vessels for containing the lubricating substance. In some examples, a plurality of vessels may contain the lubricating substance at different pressures. Lubricator injection unit 135 may comprise pumps to pump the lubricating substance via lubricator hoses 135. In some examples, lubricator injection unit may comprise a plurality of pumps to pump the lubricating substance at different pressures. In some optional examples, lubricator injection unit may also comprise a mixer to mix the lubricating substance. Lubricator injection unit 135 may be automated or may be manually operated as desired.

Figure 3:
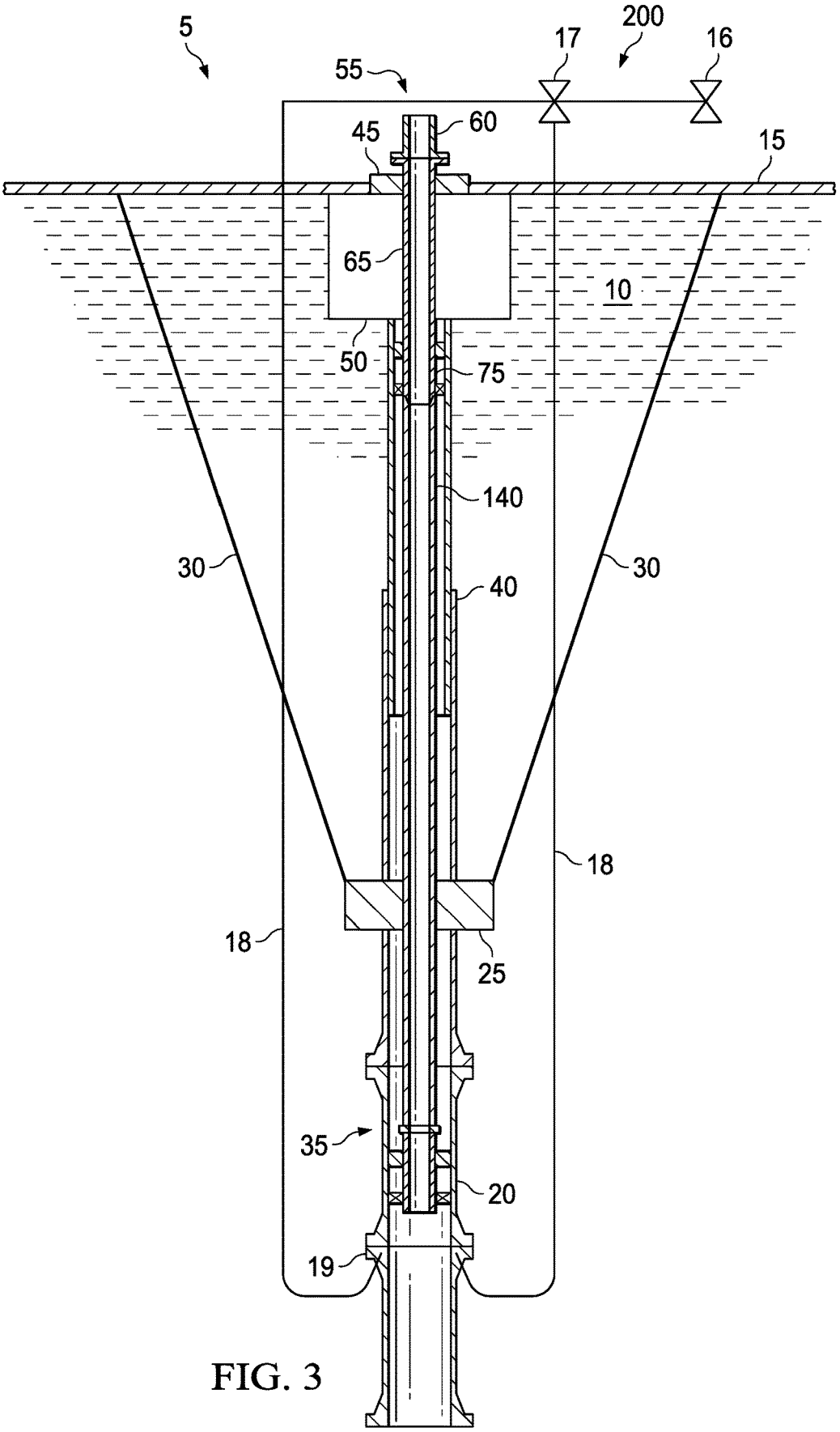
FIG. 3 is an elevation view of a well-production system.

With reference to FIG. 3, is an elevation view of a well drilling system 200 in the transition state used for wirelining or tripping operations. Well drilling system 200 may be used in offshore drilling operations conducted in body of water 10. Well drilling system 10 may be used for MPD operations in a subsea wellbore (not pictured for ease of illustration) penetrating the sea floor (not pictured for ease of illustration). Analogously to well drilling system 5 illustrated in FIGS. 1 and 2, well drilling system 200 descends from the surface of rig floor 15 and into body of water 10. Also as with well drilling system 5, an RCD 20 allows for pressure containment by creating a closed loop through which the drilling fluid circulates and through which annular pressure may be regulated as desired. Although not shown, it is to be understood that the drill string is still capable of advancing into the wellbore and rotating within this closed loop system when the well drilling system 5 is used for drilling. Generally, surface backpressure is applied via controllably adjustable chokes 16 by restricting flow through the chokes. For example, a pressure differential across the choke 16 may be adjusted to cause a corresponding change in annular pressure. In some MPD operations, a drilling fluid that is weighted to be statically underbalanced relative to pore pressure may be used. Surface back pressure may be generated by the chokes 16 to maintain a dynamic overbalanced state. Thus, a desired downhole pressure at a predetermined location (e.g., pressure at the bottom of the wellbore, pressure at a downhole casing shoe, pressure at a particular formation or zone, etc.) may be conveniently regulated by varying the backpressure applied at the surface in the closed loop created by the RCD 20. Well drilling system 200 is illustrated in the transition state used for wirelining or tripping operations. As such, the drill string is not present and a lubricator assembly 55 has been installed above the slip joint 40 or uppermost riser of the riser string 35.

Lubricator assembly 55 is the same as described in FIGS. 1 and 2 above. However, in the example illustrated by FIG. 3, lubricator seal conduit pipe 75 has been extended via lubricator seal conduit pipe extension 140. Lubricator seal conduit pipe extension 140 extends the lubricator seal conduit pipe 75 such that it is mounted within RCD 20. The length of the lubricator seal conduit pipe 75 may be adjusted by coupling additional lengths of pipe (i.e. the lubricator seal conduit pipe extension 140) to the terminal end of the lubricator seal conduit pipe 75, for example, by a threaded connection, flange-to-flange mate, etc. The lubricator seal conduit pipe 75 and lubricator seal conduit pipe extension 140 function as a concentric riser within riser string 35 and slip joint 40. In the example of FIG. 3, a latch assembly and packer assembly (e.g., latch assembly 80 and packer assembly 85 as illustrated in FIG. 2) to couple the lubricator seal conduit pipe 75 to the slip joint 40 are not present.

Figure 4:
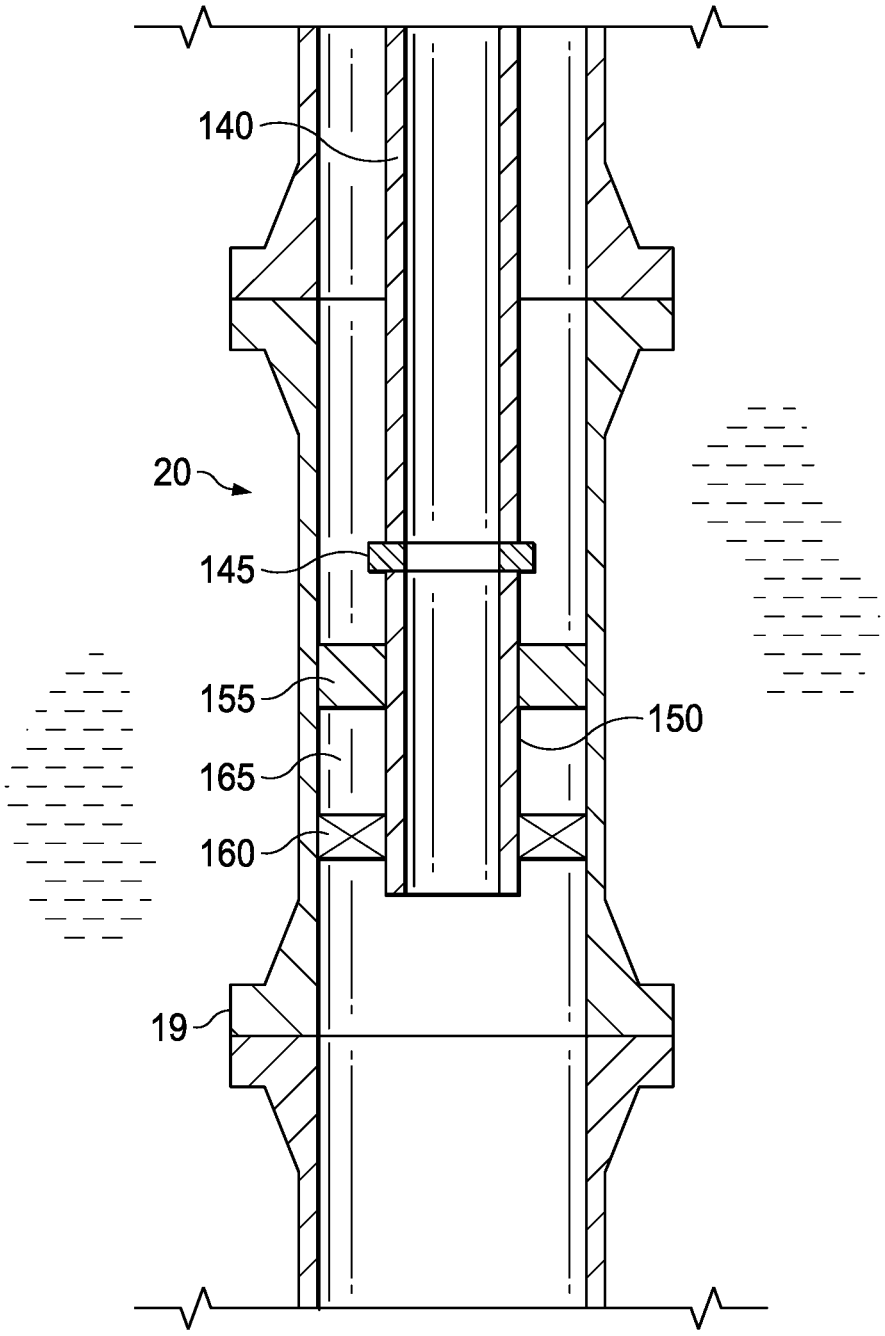
FIG. 4 is a cross-sectional view of an lubricator assembly mounted within the rotating control device of the well-production system of FIG. 3.

FIG. 4 illustrates a cross section of RCD 20 with the lubricator seal conduit pipe extension 140 extending therein. The terminal end of lubricator seal conduit pipe extension 140 is coupled to a flange adapter 145 and an RCD body adapter 150. Flange adapter 145 couples the terminal end of lubricator seal conduit pipe extension 140 to the RCD body adapter 150. Flange adapter 145 generally comprises a flange fabricated to the terminal end of the lubricator seal conduit pipe extension 140 and configured to mate with the top of the RCD body adapter 150. Although FIG. 4 illustrates a flange coupling of the lubricator seal conduit pipe extension 140 to the RCD body adapter 150, other couplings may be made as recognized by one of ordinary skill in the art. Further, in some alternative examples the lubricator seal conduit pipe extension 140 may be continuous with the RCD body adapter 150 such that no coupling is necessary. RCD body adapter 150 is a conduit comprising an RCD latch assembly 155. RCD latch assembly 155 forms a latch between the outer diameter of RCD body adapter 150 and the inner diameter of RCD 20 such that RCD latch assembly 155 is coupled to RCD 20. RCD latch assembly 155 may be any sufficient latch assembly for coupling RCD body adapter 150 to RCD 20. RCD latch assembly 155 may be a mechanical, hydraulic, or electric latch assembly. For example, RCD latch assembly 155 may be hydraulically actuated from the rig floor 15 by introducing a hydraulic pressure via tubing to the hydraulic latch setting mechanism to form a hydraulic latch between RCD body adapter 150 and RCD 20. Alternatively, RCD latch assembly 155 may be set using mechanical actuation which mates a latch profile within the RCD 20 body with a corresponding latch profile on the outer diameter of the RCD body adapter 150. It is to be understood that RCD latch assembly 155 may be any RCD latch assembly 155 sufficient for use with the disclosed well drilling system 200. It is to be understood that the apparatuses and methods described herein are not to be limited to any specific class or model of RCD latch assembly 155. Further, well drilling system 200 may utilize any equivalent configuration to RCD body adapter 150 within RCD 20.

With continued reference to FIG. 4, an optional RCD packer assembly 160 may be used to seal off the annulus 165 between the outer diameter of the RCD body adapter 150 and the inner diameter of the RCD 20. RCD packer assembly 160 comprises one or more packers sufficient for restricting fluid flow into annulus 165. The packers used for RCD packer assembly 160 may be made of any material sufficient for restricting fluid flow into annulus 165. Examples of materials may include, but are not limited to, elastomeric materials, thermoplastic materials, thermosetting materials, composites thereof, or combinations thereof. It is to be understood that RCD packer assembly 165 may be any RCD packer assembly 165 sufficient for use with the disclosed well drilling system 200 (as illustrated in FIG. 3). It is to be understood that the apparatuses and methods described herein are not to be limited to any specific class or model of RCD packer assembly 165. Further, well drilling system 200 may utilize any equivalent configuration to isolate the annulus 165 between the outer diameter of the RCD body adapter 150 and the inner diameter of the RCD 20.

In the examples illustrated by FIGS. 1-4, the sealing element of the RCD 20 has been removed. As discussed above, MPD mode may be maintained despite the removal of the sealing element of the RCD 20 and without the need to substitute the static underbalanced drilling fluid used during MPD mode with an overbalanced drilling fluid. Further, operations such as wirelining or pipe tripping may be conducted in MPD mode without risk of damage to the sealing element of the RCD 20 as it is removed prior to initiating said operations. Moreover, the speed of deployment of a wireline or tubing through the RCD may be increased as the sealing element of the RCD has been removed.

Well systems are provided in accordance with the disclosure and FIGS. 1-4. An example well system comprises a lubricator assembly. The lubricator assembly comprises a lubricator head. The lubricator head comprises a removable sealing cartridge, a plurality of sealing elements disposed in the sealing cartridge, and a lubricating fluid cavity disposed between two individual sealing elements of the plurality of sealing elements. The lubricator assembly further comprises a lubricator body. The lubricator body comprises a lubricator seal conduit pipe. The example well system also comprises a slip joint coupled to the lubricator seal conduit pipe and a statically underbalanced drilling fluid disposed in the lubricator seal conduit pipe. The sealing elements may comprise an inner diameter and be configured to allow a wireline to pass through the inner diameter. The lubricating fluid cavity may comprise a lubricating fluid disposed within the cavity and the lubricating fluid cavity may be configured to apply the lubricating fluid to a wireline passing through the lubricating fluid cavity. The well system may further comprise a lubricating fluid injection unit capable of injecting a lubricating fluid into the lubricator head at a pressure greater than that of the drilling fluid disposed in the lubricator seal conduit pipe. The slip joint may be coupled to the lubricator seal conduit pipe by a mechanical, hydraulic, or electric latch assembly. The well system may further comprise a packer assembly disposed between the slip joint and the lubricator seal conduit pipe. The well system may further comprise a rotating control device. The rotating control device may not comprise a rotating control device sealing element.

Well systems are provided in accordance with the disclosure and FIGS. 1-4. An example well system comprises a lubricator assembly. The lubricator assembly comprises a lubricator head. The lubricator head comprises a removable sealing cartridge, a plurality of sealing elements disposed in the sealing cartridge, and a lubricating fluid cavity disposed between two individual sealing elements of the plurality of sealing elements. The lubricator assembly further comprises a lubricator body. The lubricator body comprises a lubricator seal conduit pipe, a lubricator seal conduit pipe extension, and a rotating control device body adapter. The example well system further comprises a rotating control device coupled to the rotating control device body adapter and a statically underbalanced drilling fluid disposed in the lubricator seal conduit pipe. The sealing elements may comprise an inner diameter and be configured to allow a wireline to pass through the inner diameter. The lubricating fluid cavity may comprise a lubricating fluid disposed within the cavity and wherein the lubricating fluid cavity is configured to apply the lubricating fluid to a wireline passing through the lubricating fluid cavity. The well system may further comprise a lubricating fluid injection unit capable of injecting a lubricating fluid into the lubricator head at a pressure greater than that of the drilling fluid disposed in the lubricator seal conduit pipe. The rotating control device may be coupled to the rotating control device body adapter pipe by a mechanical, hydraulic, or electric latch assembly. The well system may further comprise fur a flange adapter which couples the lubricator seal conduit pipe extension to the rotating control device body adapter. The well system may further comprise a packer assembly disposed between the rotating control device body adapter and the rotating control device. The rotating control device may not comprise a rotating control device sealing element.

Methods for running a wireline into a riser string are provided in accordance with the disclosure and FIGS. 1-4. An example method comprises providing a lubricator assembly. The lubricator assembly comprises a lubricator head. The lubricator head comprises a removable sealing cartridge, a plurality of sealing elements disposed in the sealing cartridge, and a lubricating fluid cavity disposed between two individual sealing elements of the plurality of sealing elements. The lubricator assembly further comprises a lubricator body comprising a lubricator seal conduit pipe. The method further comprises passing the wireline through the lubricator assembly, wherein the lubricator assembly restricts the ingress of a drilling fluid disposed in the lubricator seal conduit pipe from flowing through the lubricator assembly while the wireline is passing through the lubricator assembly, wherein the drilling fluid is statically underbalanced. The method may further comprise injecting a lubricating fluid into the lubricator head at a pressure greater than that of a wellbore fluid disposed in the lubricator seal conduit pipe. The method may further comprise passing the wireline through a rotating control device. The rotating control device may not comprise a rotating control device sealing element. The method may further comprise passing the wireline through a slip joint coupled to the lubricator seal The sealing elements may comprise an inner diameter and be configured to allow a wireline to pass through the inner diameter. The lubricating fluid cavity may comprise a lubricating fluid disposed within the cavity and the lubricating fluid cavity may be configured to apply the lubricating fluid to a wireline passing through the lubricating fluid cavity. The well system may further comprise a lubricating fluid injection unit capable of injecting a lubricating fluid into the lubricator head at a pressure greater than that of the drilling fluid disposed in the lubricator seal conduit pipe. The slip joint may be coupled to the lubricator seal conduit pipe by a mechanical, hydraulic, or electric latch assembly. A packer assembly may be disposed between the slip joint and the lubricator seal conduit pipe.

Therefore, the disclosed systems and methods are well adapted to attain the ends and advantages mentioned, as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A well system comprising:

a lubricator assembly comprising:

a lubricator head comprising, wherein the lubricator head is disposed above a rotary table on a rig floor:

a removable sealing cartridge, a plurality of sealing elements disposed in the sealing cartridge, and a lubricating fluid cavity disposed between two individual sealing elements of the plurality of sealing elements, a lubricating fluid injection unit capable of injecting a lubricating fluid into the lubricator head at a pressure greater than that of the drilling fluid disposed in a lubricator seal conduit pipe, wherein the lubricating fluid injection unit is disposed above the rotary table on a rig floor, and a lubricator body comprising:

the lubricator seal conduit pipe;

wherein the lubricator body is disposed below the rig floor above a tension ring;

a slip joint coupled to the lubricator seal conduit pipe, a statically underbalanced drilling fluid disposed in the lubricator seal conduit pipe, and a packer assembly disposed between the slip joint and the lubricator seal conduit pipe.

2. The well system of claim 1, wherein the sealing elements comprise an inner diameter and are configured to allow a wireline to pass through the inner diameter.

3. The well system of claim 1, wherein the lubricating fluid cavity comprises a lubricating fluid disposed within the cavity and wherein the lubricating fluid cavity is configured to apply the lubricating fluid to a wireline passing through the lubricating fluid cavity.

4. The well system of claim 1, wherein the slip joint is coupled to the lubricator seal conduit pipe by a mechanical, hydraulic, or electric latch assembly.

5. The well system of claim 1, further comprising a rotating control device.

6. The well system of claim 5, wherein the rotating control device does not comprise a rotating control device sealing element.

7. A well system comprising:

a lubricator assembly comprising:

a lubricator head comprising, wherein the lubricator head is disposed above a rotary table on a rig floor:

a removable sealing cartridge, a plurality of sealing elements disposed in the sealing cartridge, and a lubricating fluid cavity disposed between two individual sealing elements of the plurality of sealing elements, a lubricating fluid injection unit capable of injecting a lubricating fluid into the lubricator head at a pressure greater than that of the drilling fluid disposed in a lubricator seal conduit pipe, wherein the lubricating fluid injection unit is disposed above the rotary table on a rig floor, and a lubricator body comprising:

the lubricator seal conduit pipe, a lubricator seal conduit pipe extension, and a rotating control device body adapter;

wherein the lubricator body is disposed below the rig floor above a tension ring;

a rotating control device coupled to the rotating control device body adapter, a statically underbalanced drilling fluid disposed in the lubricator seal conduit pipe, and a packer assembly disposed between the rotating control device body adapter and the rotating control device.

8. The well system of claim 7, wherein the sealing elements comprise an inner diameter and are configured to allow a wireline to pass through the inner diameter.

9. The well system of claim 7, wherein the lubricating fluid cavity comprises a lubricating fluid disposed within the cavity and wherein the lubricating fluid cavity is configured to apply the lubricating fluid to a wireline passing through the lubricating fluid cavity.

10. The well system of claim 7, wherein the rotating control device is coupled to the rotating control device body adapter pipe by a mechanical, hydraulic, or electric latch assembly.

11. The well system of claim 7, further comprising a flange adapter which couples the lubricator seal conduit pipe extension to the rotating control device body adapter.

12. The well system of claim 7, wherein the rotating control device does not comprise a rotating control device sealing element.

13. A method for running a wireline into a riser string:

providing a lubricator assembly comprising:

a lubricator head, wherein the lubricator head is disposed above a rotary table on a rig floor, wherein the lubricator head comprises:

a removable sealing cartridge, a plurality of sealing elements disposed in the sealing cartridge, and a lubricating fluid cavity disposed between two individual sealing elements of the plurality of sealing elements, a lubricating fluid injection unit capable of injecting a lubricating fluid into the lubricator head at a pressure greater than that of the drilling fluid disposed in a lubricator seal conduit pipe, wherein the lubricating fluid injection unit is disposed above the rotary table on a rig floor, and a lubricator body comprising:

the lubricator seal conduit pipe;

wherein the lubricator body is disposed below the rig floor above a tension ring, passing the wireline through the lubricator assembly, wherein the lubricator assembly restricts the ingress of a drilling fluid disposed in the lubricator seal conduit pipe from flowing through the lubricator assembly while the wireline is passing through the lubricator assembly, wherein the drilling fluid is statically underbalanced, and passing the wireline through a rotating control device, wherein a packer assembly is disposed between a rotating control device body adapter and the rotating control device.

14. The method of claim 13, injecting a lubricating fluid into the lubricator head at a pressure greater than that of a wellbore fluid disposed in the lubricator seal conduit pipe.

15. The method of claim 13, wherein the rotating control device does not comprise a rotating control device sealing element.

* * * * *